US012631002B2

(12) United States Patent
Velde

(10) Patent No.: US 12,631,002 B2
(45) Date of Patent: May 19, 2026

(54) UNINTERRUPTED AUTOMATIC POSITION CONTROL OF WORK IMPLEMENTS DURING OVERRIDE OF TARGET SETTINGS

(71) Applicant: Deere & Company, Moline, IL (US)

(72) Inventor: Todd F. Velde, Dubuque, IA (US)

(73) Assignee: Deere & Company, Moline, IL (US)

( * ) Notice: Subject to any disclaimer, the term of this patent is extended or adjusted under 35 U.S.C. 154(b) by 259 days.

(21) Appl. No.: 18/160,147

(22) Filed: Jan. 26, 2023

(65) Prior Publication Data

US 2024/0254727 A1 Aug. 1, 2024

(51) Int. Cl.
*E02F 9/20* (2006.01)
*E02F 3/84* (2006.01)

(52) U.S. Cl.
CPC ..... *E02F 9/2004* (2013.01); *E02F 3/844* (2013.01)

(58) Field of Classification Search
CPC ..... E02F 9/00; E02F 3/00; G05G 1/00
See application file for complete search history.

(56) References Cited

U.S. PATENT DOCUMENTS

| | | | | |
|---|---|---|---|---|
| 6,233,511 | B1 * | 5/2001 | Berger | E02F 3/432 701/50 |
| 8,412,420 | B2 | 4/2013 | Ruhter et al. | |
| 8,424,632 | B2 | 4/2013 | Ruhter et al. | |
| 8,500,387 | B2 | 8/2013 | Trifunovic | |
| 8,567,551 | B2 | 10/2013 | Trifunovic | |
| 9,227,478 | B2 | 1/2016 | Horstman | |
| 9,328,479 | B1 | 5/2016 | Rausch et al. | |
| 9,637,889 | B2 | 5/2017 | Elkins | |
| 9,904,290 | B2 | 2/2018 | Pickett et al. | |
| 10,030,358 | B2 | 7/2018 | Wallace et al. | |
| 10,076,939 | B2 | 9/2018 | Simon et al. | |

(Continued)

FOREIGN PATENT DOCUMENTS

| | | | |
|---|---|---|---|
| DE | 102021210524 | A1 | 4/2022 |
| EP | 2944727 | A2 | 11/2015 |

OTHER PUBLICATIONS

German Search Report issued in application No. 102023128332.4 dated Jun. 11, 2024, 14 pages.

*Primary Examiner* — Aniss Chad
*Assistant Examiner* — Elizabeth J Slowik
(74) *Attorney, Agent, or Firm* — Gary L. Montle; Lucian Wayne Beavers; Patterson Intellectual Property Law, PC

(57) ABSTRACT

A system and method are provided for automatically controlling operating characteristics for a work vehicle such as a dozer having a controllable blade. User-selectable transitions between manual and automatic control modes are enabled, with control based on a settable target value for an operating characteristic, e.g., blade elevation. During the manual control mode, a magnitude of manual adjustment via a user interface tool corresponds to a velocity of adjustment from a previous setting to a new setting for the target value. During the automatic control mode, a magnitude of manual adjustment via the user interface tool corresponds to an amount of adjustment from the previous setting to the new setting. Also during the automatic control mode, control signals associated with the operating characteristic are continuously generated based on at least the first target value and uninterrupted by any manual adjustments via the user interface tool to the first target value.

17 Claims, 3 Drawing Sheets

(56) References Cited

U.S. PATENT DOCUMENTS

| | | | | |
|---|---|---|---|---|
| 10,526,766 | B2 | 1/2020 | Hageman et al. | |
| 10,634,492 | B2 | 4/2020 | Beery et al. | |
| 10,704,226 | B2 | 7/2020 | Yamaguchi et al. | |
| 10,883,248 | B2 | 1/2021 | Stotlar | |
| 10,952,021 | B2 | 3/2021 | Kean et al. | |
| 10,975,547 | B2 | 4/2021 | Mahrenholz | |
| 11,053,663 | B2 | 7/2021 | Kean et al. | |
| 11,124,943 | B2 | 9/2021 | Kean et al. | |
| 11,499,294 | B2 | 11/2022 | Vandegrift et al. | |
| 2011/0169949 | A1 | 7/2011 | Mccain et al. | |
| 2013/0261902 | A1* | 10/2013 | Zhdanov | E02F 3/7618 701/50 |
| 2014/0064897 | A1 | 3/2014 | Montgomery | |
| 2014/0343800 | A1 | 11/2014 | Nelson et al. | |
| 2015/0165856 | A1 | 6/2015 | Horstman | |
| 2016/0265185 | A1* | 9/2016 | Imaizumi | E02F 9/2029 |
| 2016/0338258 | A1* | 11/2016 | Wood | A01B 63/004 |
| 2016/0362870 | A1 | 12/2016 | Elkins | |
| 2017/0081826 | A1* | 3/2017 | Ferracin | E02F 9/2296 |
| 2017/0275848 | A1* | 9/2017 | Marquette | E02F 9/265 |
| 2018/0061040 | A1 | 3/2018 | Beery et al. | |
| 2018/0230672 | A1* | 8/2018 | Matsuyama | E02F 3/437 |
| 2020/0087887 | A1 | 3/2020 | Kean et al. | |
| 2020/0087888 | A1 | 3/2020 | Kean et al. | |
| 2020/0318316 | A1* | 10/2020 | Kjaergaard | E02F 9/2037 |
| 2020/0392696 | A1* | 12/2020 | Zuo | E02F 9/2041 |
| 2021/0071390 | A1* | 3/2021 | Kean | E02F 9/262 |
| 2021/0311584 | A1* | 10/2021 | Mcnamee | E02F 9/2012 |
| 2022/0126827 | A1 | 4/2022 | Sahoo et al. | |
| 2022/0325498 | A1* | 10/2022 | Knowles | E02F 9/10 |
| 2022/0396191 | A1* | 12/2022 | Hebert | E02F 9/2228 |
| 2023/0151582 | A1* | 5/2023 | Busquets | E02F 3/431 74/471 R |
| 2023/0257964 | A1* | 8/2023 | Nakano | E02F 3/841 701/50 |

* cited by examiner

UNINTERRUPTED AUTOMATIC POSITION CONTROL OF WORK IMPLEMENTS DURING OVERRIDE OF TARGET SETTINGS

FIELD OF THE DISCLOSURE

The present disclosure relates generally to work vehicles such as for example self-propelled work vehicles which include ground-engaging work implements mounted thereon. More particularly, the present disclosure relates to systems and methods configured to enable operator override of target settings using an interface tool such as a joystick, without interrupting automatic control functions.

BACKGROUND

Work vehicles of this type may for example include dozers, compact track loaders, excavator machines, motor graders, skid steer loaders, and other work vehicles which grade or otherwise modify the terrain or equivalent working environment in some way, and which may be self-propelled in nature. Work vehicles with ground-engaging work implements such as blades may be most relevant in the context of the present disclosure with respect to their inherent capabilities for shaping and smoothing ground surfaces. However, contemplated work vehicles within the scope of the present disclosure are not limited to those with ground engaging work implements and may also include various other work vehicles with automatic position control, such as for example harvesters, unloading augers, tractors, articulated dump trucks, and the like.

When an automatic position control system such as grade control is active, the operator may desire to temporarily adjust the position of the work implement without interrupting the automatic position control itself. With conventional user interface tools, such as for example joysticks mounted within the operator cab of the work vehicle, operator inputs relate to a velocity of change in the position of the work implement. However, using the conventional joystick configuration there is no corresponding mechanism to hold the work implement at an adjusted position once it has been moved. A zero-velocity command corresponds to a neutral joystick position, which is disadvantageously interpreted by the automatic position control system as meaning that the operator wants to resume automatic control.

One possible solution is that operator input interrupts the automated control, so that it does not programmatically resume when the operator returns the joystick to neutral. However, this has the disadvantage of requiring the operator to provide or otherwise initiate a signal each time that resumption of automatic control is desired.

BRIEF SUMMARY

The current disclosure provides an enhancement to conventional systems, at least in part by introducing a novel system and method for interpreting an operator's input as a magnitude of work implement position adjustment rather than a work implement velocity. The automatic position control system may continue to generate control signals, but with an adjustment to a target position provided by the operator via the user interface tool, e.g., joystick. In some embodiments, the automatic position control system can continue to continuously reject disturbances like frame motion, and the operator can simultaneously control a transition away from, and back to, the target position (e.g., target elevation of at least a ground-engaging portion of the work implement) using the joystick, and without disrupting the automatic control otherwise. The operator may still retain various mechanisms for manually interrupting automatic control and returning to manual work implement velocity control by, e.g., moving the joystick beyond a threshold position, or by disabling automatic control via a button associated therewith.

In one embodiment, a method is accordingly disclosed herein for automatically controlling one or more operating characteristics for a self-propelled work vehicle, the method including enabling a user-selectable transition of control based on at least a first target value for at least one of the one or more operating characteristics between a manual control mode and an automatic control mode, wherein during the manual control mode a magnitude of manual adjustment via a user interface tool corresponds to a velocity of adjustment from a previous setting to a new setting for the first target value, and wherein during the automatic control mode a magnitude of manual adjustment via the user interface tool corresponds to an amount of adjustment from the previous setting to the new setting with respect to the first target value. The method further includes, during the automatic control mode, continuously generating control signals associated with the at least one of the one or more operating characteristics based on at least the first target value and uninterrupted by any manual adjustments via the user interface tool to the first target value.

In one exemplary aspect according to the above-referenced embodiment, the work vehicle comprises a front-mounted work implement configured to work a terrain to at least a target mainfall and a target cross-slope, wherein an actuator associated with the work implement is configured, responsive to the generated control signals, to controllably adjust an operating characteristic comprising elevation of the work implement to the first target value.

In another exemplary aspect according to the above-referenced embodiment, the user interface tool is manually translatable from a neutral position along at least two different trajectories, wherein translation along a first trajectory for the user interface tool corresponds to changes in elevation for the work implement, and wherein translation along a second trajectory for the user interface tool corresponds to changes in tilt for the work implement.

In another exemplary aspect according to the above-referenced embodiment, during the automatic mode a first manual translation of the user interface tool from the neutral position along the first trajectory causes the work implement to be actuated from a first position to a second position relative to a frame of the work vehicle, and a second manual translation of the user interface tool back to the neutral position along the first trajectory causes the work implement to be actuated from the second position back to the first position relative to the frame of the work vehicle.

In another exemplary aspect according to the above-referenced embodiment, the transition of control between the manual control mode and the automatic control mode is executed at least responsive to manual translation of the user interface tool at least a threshold distance from the neutral position.

In another exemplary aspect according to the above-referenced embodiment, the user interface tool comprises a joystick that is manually translatable from the neutral position along the at least two trajectories, and a button associated with the joystick wherein the transition of control between the manual control mode and the automatic control mode is further executed at least responsive to manual engagement of the button.

In another embodiment, a self-propelled work vehicle as disclosed herein comprises a frame supported by one or more ground engaging units, and a controller configured to direct the performance of steps in a method according to the above-referenced method embodiment and optionally any one or more of the associated and exemplary aspects.

In another embodiment, a system as disclosed herein comprises a work vehicle and one or more processors configured to direct the performance of steps in a method according to the above-referenced method embodiment and optionally any one or more of the associated and exemplary aspects.

Numerous objects, features and advantages of the embodiments set forth herein will be readily apparent to those skilled in the art upon reading of the following disclosure when taken in conjunction with the accompanying drawings.

DETAILED DESCRIPTION

Figure 1:
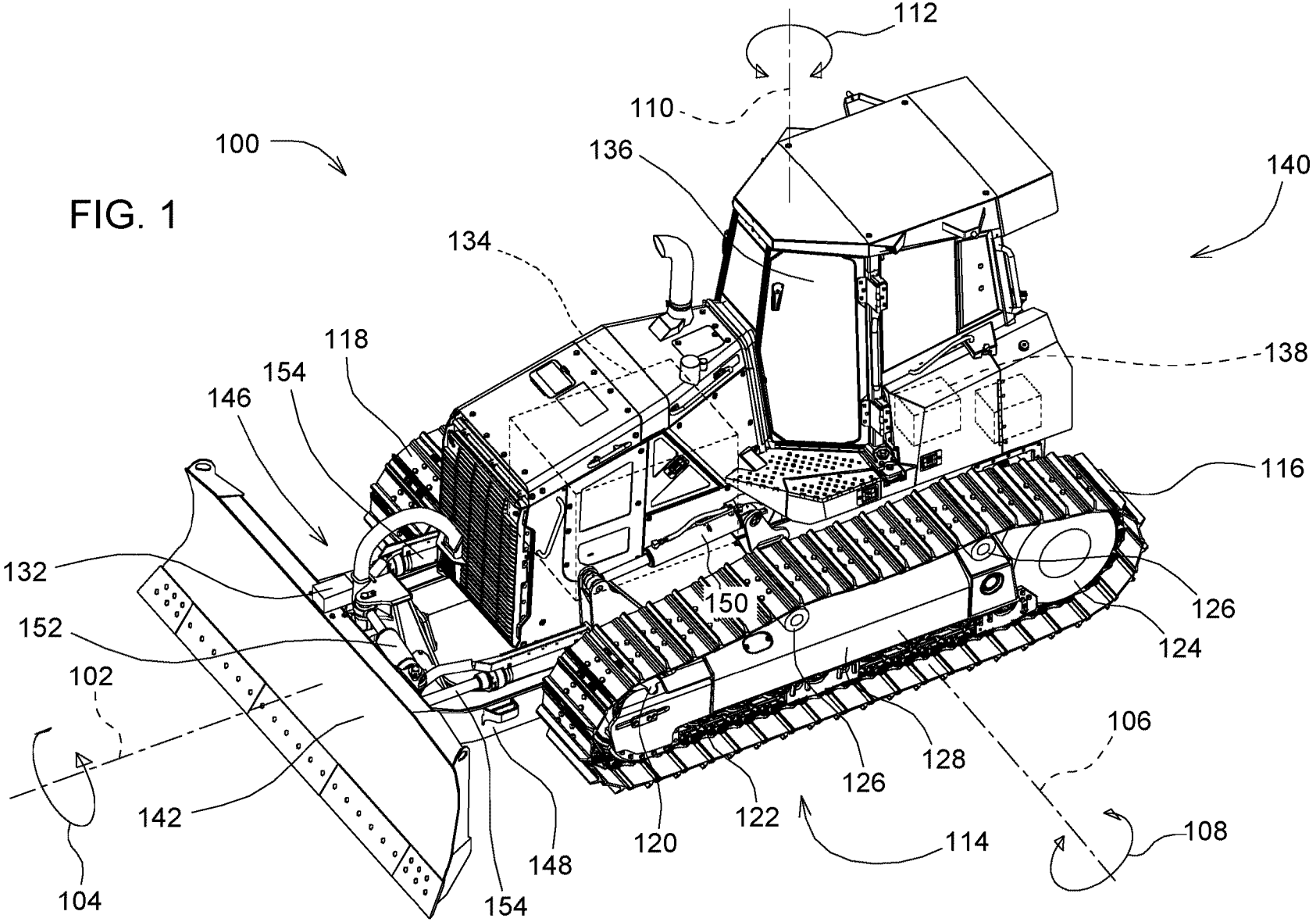
FIG. 1 is a perspective view of a tracked work vehicle incorporating an embodiment of a work vehicle and method as disclosed herein.

FIG. 1 is a perspective view of a work vehicle 100. In the illustrated embodiment, the work vehicle 100 is a crawler dozer, but may in other embodiments within the scope of the present disclosure be alternative work vehicles having a ground-engaging blade or other work implement 142 such as a compact track loader, motor grader, scraper, skid steer, backhoe, and tractor, to name but a few examples. The work vehicle 100 may be operated to engage the ground and grade, cut, and/or move material to achieve simple or complex features on the ground. While operating, the work vehicle 100 may experience movement in three directions and rotation in three directions. A direction for the work vehicle 100 may also be referred to with regard to a longitudinal direction 102, a latitudinal or lateral direction 106, and a vertical direction 110. Rotation for work vehicle 100 may be referred to as roll 104 or the roll direction, pitch 108 or the pitch direction, and yaw 112 or the yaw direction or heading.

An operator cab 136 may be located on a frame 140. The operator cab and the work implement 142 may both be mounted on the frame 140 so that at least in certain embodiments the operator cab faces in the working direction of the work implement 142, such as for example where the work implement 142 is front-mounted.

The illustrated work vehicle 100 is supported on the ground by an undercarriage 114. The undercarriage 114 includes ground engaging units 116, 118, which in the present example are formed by a left track 116 and a right track 118 but may in certain embodiments be formed by alternative arrangements including wheeled ground engaging units, and provide tractive force for the work vehicle 100. Each track may be comprised of shoes with grousers that sink into the ground to increase traction, and interconnecting components that allow the tracks to rotate about front idlers 120, track rollers 122, rear sprockets 124 and top idlers 126. Such interconnecting components may include links, pins, bushings, and guides, to name a few components. Front idlers 120, track rollers 122, and rear sprockets 124, on both the left and right sides of the work vehicle 100, provide support for the work vehicle 100 on the ground. Front idlers 120, track rollers 122, rear sprockets 124, and top idlers 126 are all pivotally connected to the remainder of the work vehicle 100 and rotationally coupled to their respective tracks so as to rotate with those tracks. The track frame 128 provides structural support or strength to these components and the remainder of the undercarriage 114. In alternative embodiments, the ground engaging units 116, 118 may comprise, e.g., wheels on the left and right sides of the work vehicle.

Each of the rear sprockets 124 may be powered by a rotationally coupled hydraulic motor so as to drive the left track 116 and the right track 118 and thereby control propulsion and traction for the work vehicle 100. Each of the left and right hydraulic motors may receive pressurized hydraulic fluid from a hydrostatic pump whose direction of flow and displacement controls the direction of rotation and speed of rotation for the left and right hydraulic motors. Each hydrostatic pump may be driven by an engine 134 (or equivalent power source) of the work vehicle and may be controlled by an operator in the operator cab 136 issuing commands which may be received by a controller 138 and communicated to the left and right hydrostatic pumps. In alternative embodiments, each of the rear sprockets may be driven by a rotationally coupled electric motor or a mechanical system transmitting power from the engine.

The work implement 142 of the present example is a blade which may engage the ground or material, for example to move material from one location to another and to create features on the ground, including flat areas, grades, hills, roads, or more complexly shaped features. In this embodiment, the work implement 142 of the work vehicle 100 may be referred to as a six-way blade, six-way adjustable blade, or power-angle-tilt (PAT) blade. The blade may be hydraulically actuated to move vertically up or down ("lift"), roll left or right ("tilt"), and yaw left or right ("angle"). Alternative embodiments may utilize a blade with fewer hydraulically controlled degrees of freedom, such as a 4-way blade that may not be angled or actuated in the direction of yaw 112.

The work implement 142 is movably connected to the frame 140 of the work vehicle 100 through a linkage 146 which supports and actuates the blade and is configured to allow the blade to be lifted (i.e., raised or lowered in the vertical direction 110) relative to the frame. The linkage 146 includes a c-frame 148, a structural member with a C-shape positioned rearward of the blade, with the C-shape open toward the rear of the work vehicle 100. The blade may be lifted (i.e., raised or lowered) relative to the work vehicle 100 by the actuation of lift cylinders 150, which may raise and lower the c-frame 148. The blade may be tilted relative to the work vehicle 100 by the actuation of a tilt cylinder 152, which may also be referred to as moving the blade in the direction of roll 104. The blade may be angled relative to the work vehicle 100 by the actuation of angle cylinders 154, which may also be referred to as moving the blade in the direction of yaw 112. Each of the lift cylinders 150, tilt cylinder 152, and angle cylinders 154 may be a double acting hydraulic cylinder.

A control station including a user interface 162 (not shown in FIG. 1) may be located in the operator cab 136. As used herein, directions with regard to work vehicle 100 may be referred to from the perspective of an operator seated within the operator cab 136: the left of work vehicle is to the left of such an operator, the right of work vehicle is to the right of such an operator, the front or fore of work vehicle 100 is the direction such an operator faces, the rear or aft of work vehicle is behind such an operator, the top of work vehicle is above such an operator, and the bottom of work vehicle is below such an operator.

Figure 2:
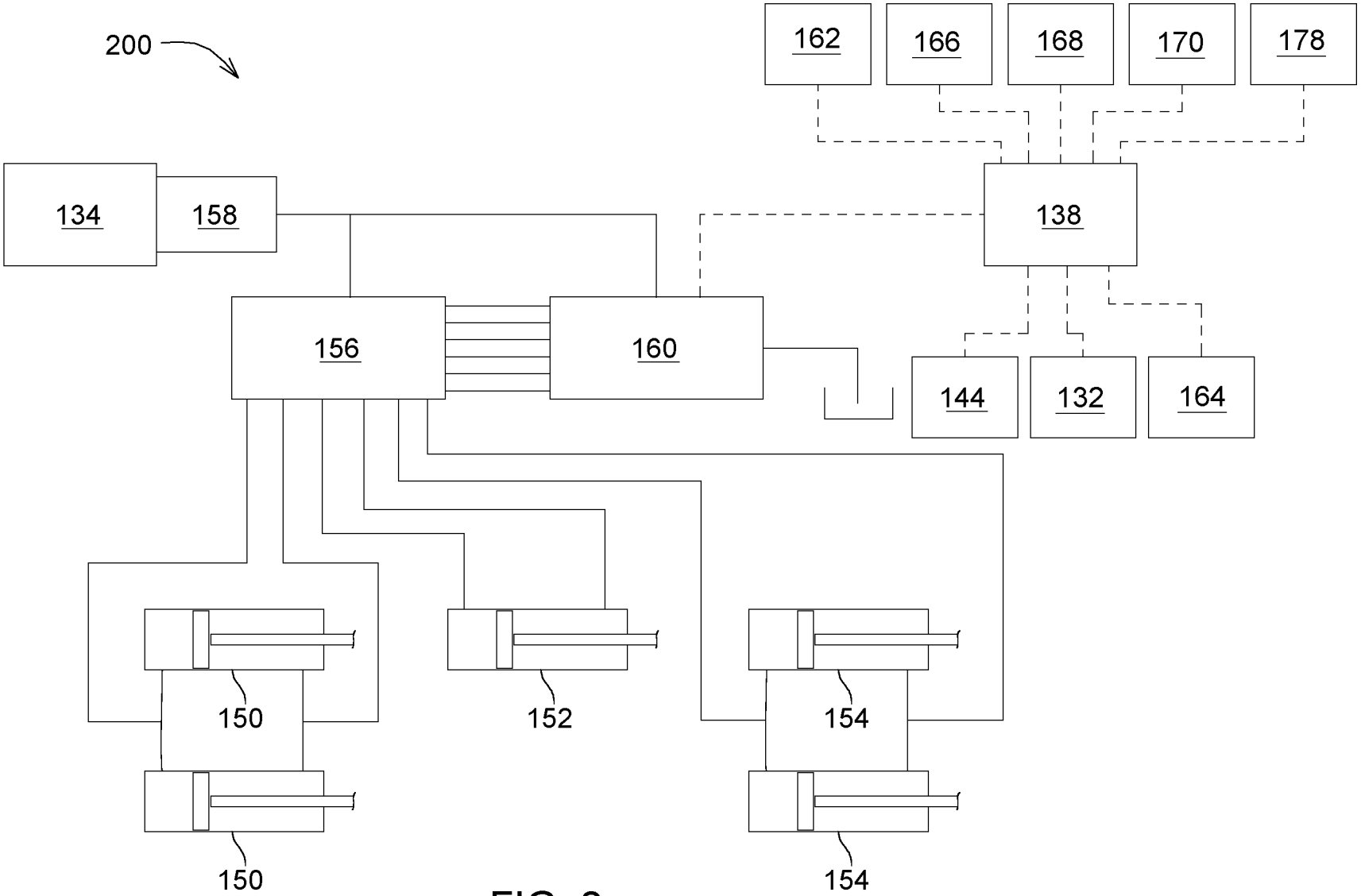
FIG. 2 is a block diagram representing an exemplary control system for the work vehicle according to an embodiment of a system as disclosed herein.

The term "user interface" 162 as used herein may broadly take the form of a display unit and/or other outputs from the system such as indicator lights, audible alerts, and the like. Referring now to FIG. 2, the user interface 162 may further include, or additional components associated with the user interface may include, various user interface tools (e.g., including a first joystick 166 located on the left side of an operator while seated in the operator cab 136, a second joystick 168 located on the right side of an operator while seated in the operator cab 136, and a button 170 which may be located on a control panel, dashboard, or otherwise integrated with one of the joysticks 166, 168 as further described below) for operating various aspects of the work vehicle 100, including operation of the engine, positioning of the work implement 142, and the like. Such an onboard user interface 162 and associated tools 166, 168, 170 may be coupled to a vehicle control system via for example a CAN bus arrangement or other equivalent forms of electrical and/or electro-mechanical signal transmission. Another form of user interface (not shown) may take the form of a display unit (not shown) that is generated on a remote (i.e., not onboard) computing device, which may display outputs such as status indications and/or otherwise enable user interaction such as the providing of inputs to the system. In the context of a remote user interface, data transmission between for example the vehicle control system and the user interface may take the form of a wireless communications system and associated components as are conventionally known in the art.

The illustrated work vehicle 100 further includes a control system 200 including a controller 138. The controller 138 may be part of the machine control system of the working machine, or it may be a separate control module. The controller 138 may include or be functionally linked to the user interface 162 and optionally be mounted in the operators cab 136 at a control panel. It may be understood that the controller 138 described herein may be a single controller having some or all of the described functionality, or it may include multiple controllers wherein some or all of the described functionality is distributed among the multiple controllers.

The controller 138 is configured to receive input signals from some or all of various sensors associated with the work vehicle 100, which may include for example a set of one or more sensors 144 affixed to the frame 140 of the work vehicle 100 and configured to provide signals indicative of, e.g., an inclination (cross-slope) of the frame, a set of one or more sensors 132 affixed to the work implement 142 of the work vehicle 100 and configured to provide signals indicative of a position and orientation thereof, and one or more sensors 164, for example imaging devices 164, affixed to the work vehicle 100 and configured to capture images associated with components of the work vehicle 100 and/or the surroundings thereof. In alternative embodiments, such sensors 132, 144, 164 may not be affixed directly to the 140, work implement 142, or other components of the work vehicle 100, but may instead be connected through intermediate components or structures, such as rubberized mounts.

Sensors 144 may be configured to provide at least a signal indicative of the inclination of the frame 140 relative to the direction of gravity, or to provide a signal or signals indicative of other positions or velocities of the frame, including its angular position, velocity, or acceleration in a direction such as the direction of roll 104, pitch 108, yaw 112, or its linear acceleration in a longitudinal direction 102, latitudinal direction 106, and/or vertical direction 110.

Sensors 144 may be configured to directly measure inclination, or for example to measure angular velocity and integrate to arrive at inclination, and may typically, e.g., be comprised of an inertial measurement unit (IMU) mounted on the frame 140 and configured to provide at least a frame inclination (slope) signal, or signals corresponding to the scope of the frame 140, as inputs to the controller 138. Such an IMU may for example be in the form of a three-axis gyroscopic unit configured to detect changes in orientation of the sensor, and thus of the frame 140 to which it is fixed, relative to an initial orientation.

In other embodiments, one or more of the sensors 132, 144 may include a plurality of GPS sensing units fixed relative to the frame 140 and/or the work implement 142, which can detect the absolute position and orientation of the work vehicle 100 within an external reference system, and can detect changes in such position and orientation.

It may be understood that the various sensors 132, 144 may transmit output signals representative of the respectively measured values to the controller 138, wherein the controller 138 is further configured to determine for example a position and orientation of the work implement 142 based on the received output signals. The controller 138 may be configured to compare the measured position and orientation of the work implement 142 to respective target values, wherein an error value may be calculated based on a difference between the measured position and a target position and an error value may be calculated based on a difference between the measured orientation and a target orientation. The error signals may then be used by the controller 138 to generate control signals to appropriate actuators as further described herein for minimizing the calculated errors. The measured position of the work implement 142 in an embodiment may correspond to a measured elevation of a ground-engaging portion of the work implement 142 with respect to a reference ground surface or to a reference component associated with the work vehicle 100, whereas the measured orientation in this embodiment may correspond to a measured tilt in a latitudinal/transverse axis of the work implement 142 with respect to the reference ground surface or to the reference component associated with the work vehicle 100.

The controller 138 in an embodiment (not shown) may include or may be associated with a processor, a computer readable medium, a communication unit, data storage 178 such as for example a database network, and the aforementioned user interface 142 or control panel having a display.

Various operations, steps or algorithms as described in connection with the controller 138 can be embodied directly in hardware, in a computer program product such as a software module executed by a processor, or in a combination of the two. The computer program product can reside in RAM memory, flash memory, ROM memory, EPROM memory, EEPROM memory, registers, hard disk, a removable disk, or any other form of computer-readable medium known in the art. An exemplary computer-readable medium can be coupled to the processor such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

The communication unit may support or provide communications between the controller 138 and external systems or devices, and/or support or provide communication interface with respect to internal components of the work machine 100. The communications unit may include wireless communication system components (e.g., via cellular modem, WiFi, Bluetooth or the like) and/or may include one or more wired communications terminals such as universal serial bus ports.

Data storage 178 as discussed herein may, unless otherwise stated, generally encompass hardware such as volatile or non-volatile storage devices, drives, memory, or other storage media, as well as one or more databases residing thereon.

The control system 200 may include hydraulic and electrical components for controlling a position of the front-mounted work implement 142. For example, each of the lift cylinders 150, the tilt cylinder 152, and the angle cylinders 154 may be hydraulically connected to a hydraulic control valve 156, which receives pressurized hydraulic fluid from a hydraulic pump 158, which may be rotationally connected to the engine 134, and directs such fluid to the lift cylinders 150, the tilt cylinder 152, the angle cylinders 154, and other hydraulic circuits or functions of the work machine 100. The hydraulic control valve 156 may meter such fluid out, or control the flow rate of hydraulic fluid to, each hydraulic circuit to which it is connected. In alternative embodiments, the hydraulic control valve 156 may not meter such fluid out but may instead only selectively provide flow paths to these functions while metering is performed by another component (e.g., a variable displacement hydraulic pump) or not performed at all. The hydraulic control valve 156 may meter such fluid out through a plurality of spools, whose positions control the flow of hydraulic fluid, and other hydraulic logic. The spools may be actuated by solenoids, pilots (e.g., pressurized hydraulic fluid acting on the spool), the pressure upstream or downstream of the spool, or some combination of these and other elements.

In various embodiments, the controller 138 may send commands to actuate the work implement 142 in a number of different manners. As one example, the controller 138 may be in communication with a valve controller via a controlled area network (CAN) and may send command signals to the valve controller in the form of CAN messages. The valve controller may receive these messages from the controller 138 and send current to specific solenoids within the electrohydraulic pilot valve 160 based on those messages. As another example, the controller may actuate the work implement 142 by actuating an input in the operator cab 136. For example, an operator may use joystick 166 to issue commands to actuate the work implement 142, and the joystick may generate hydraulic pressure signals, pilots, which are communicated to the hydraulic control valve 156 to cause the actuation of the work implement. In such a configuration, the controller 138 may be in communication with electrical devices (e.g., solenoids, motors) which may actuate a joystick 166 in the operator cab. In this way, the controller may actuate the work implement 142 by actuating these electrical devices instead of communicating signals to electrohydraulic pilot valve 160.

The controller 138 of the work machine 100 may be configured to produce outputs, as further described below, to a user interface 142 associated with a display unit for display to the human operator. The controller 138 may be configured to receive inputs from the user interface 142, such as user input provided via the user interface 142. Not specifically represented in FIG. 2, the controller 138 of the work machine 100 may in some embodiments further receive inputs from and generate outputs to remote devices associated with a user via a respective user interface, for example a display unit with touchscreen interface. Data transmission between for example the vehicle control system and a remote user interface may take the form of a wireless communications system and associated components as are conventionally known in the art. In certain embodiments, a remote user interface and vehicle control systems for respective work machines may be further coordinated or otherwise interact with a remote server or other computing device for the performance of operations in a system as disclosed herein.

Figure 3:
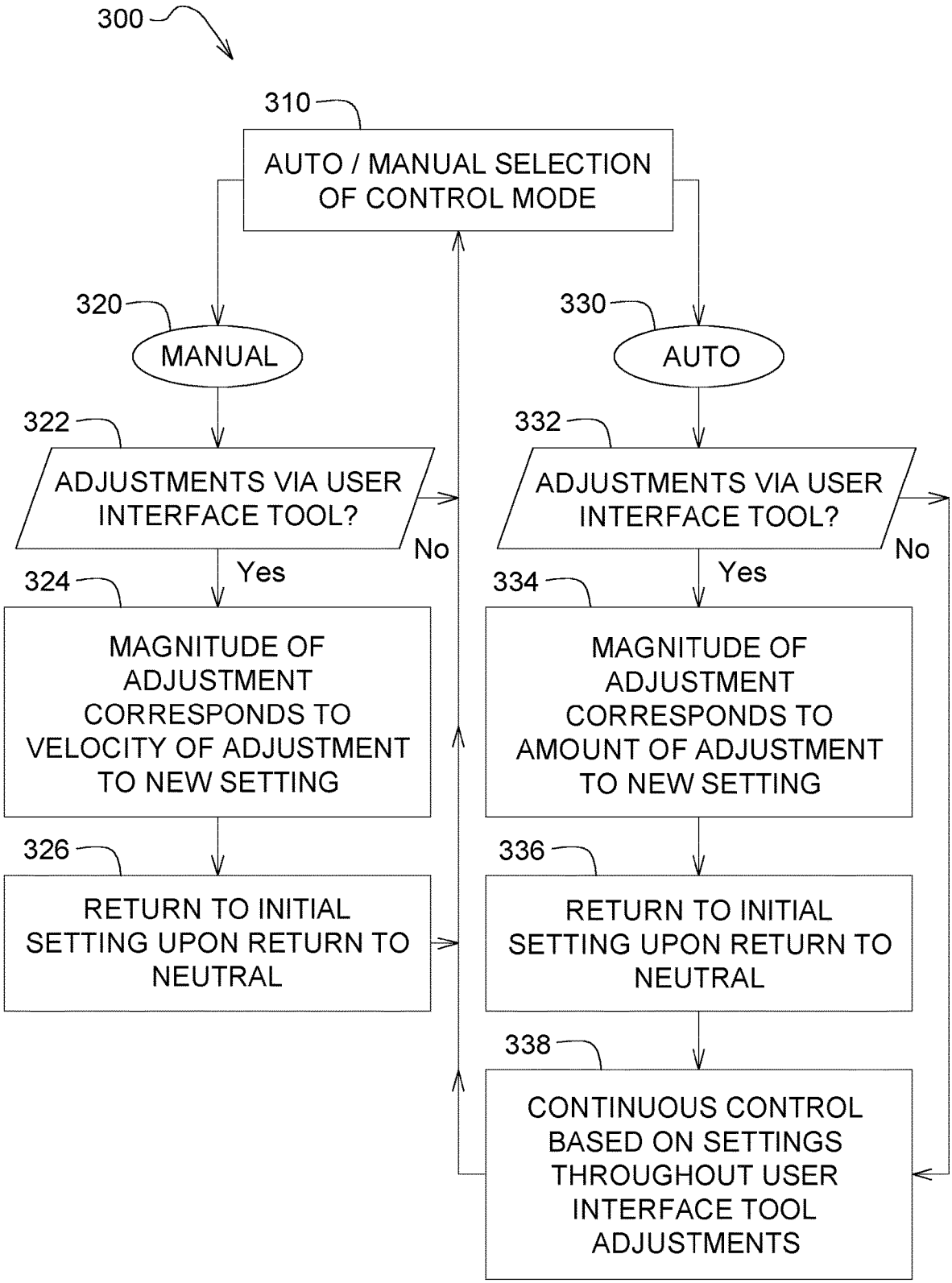
FIG. 3 is a flowchart representing an exemplary embodiment of a method as disclosed herein.

An embodiment of a method 300 of the present disclosure may now be described with further illustrative reference to FIG. 3. The present embodiment is intended as illustrative and the associated description is not limiting on the scope of any other embodiments unless otherwise specifically noted herein. It should also be noted that various steps as disclosed in accordance with the present embodiment may be combined, omitted, or supplemented by one of skill in the art when considering the applicable functions and without necessarily altering the scope of the present disclosure, unless otherwise expressly provided herein.

A first step 310 of the method 300 as illustrated includes enabling, for example via user engagement of a button 170 or switch that is discrete (e.g., in a separate area of the user interface 162/control panel) or otherwise integrated with a joystick 166, 168, a user-selectable transition between manual and automatic control modes.

In alternative embodiments, the transition of control between the manual control mode and the automatic control mode may be executed at least responsive to manual translation of a joystick 166, 168 at least a threshold distance from its respective neutral position. In one example of such an embodiment, a first joystick 166 as further described below may be utilized to provide control signals based on first (forward or backward along a y-axis) and second (left or right along an x-axis) trajectories, wherein movement along the first trajectory corresponds to elevation control signals for the work implement 142 but an amount of movement for the joystick 166 along the first trajectory has the further result of interrupting automatic control and returning to a manual control mode. In another example, the first joystick 166 may retain the above-referenced functionality with respect to elevation control signals responsive to movements along the first trajectory, but a specified movement of a second joystick 168 may instead be utilized to interrupt automatic control and return to the manual control mode.

In an embodiment, the manual and automatic control modes at issue may relate at least to control based on at least a first target value for at least an elevation of the work implement 142, namely the ground-engaging portion of the blade for the work vehicle 100.

It may be understood that other target values, thresholds, and/or conditions may be set and controllable with respect to the elevation of the work implement 142, and that target values, thresholds, and/or conditions may be set and controllable with respect to other characteristics of the work implement 142 or of a resulting configuration of the terrain being worked, such as for example cross-slope, mainfall, or various other topographical dimensions as may be relevant for the earth working application. It may further be understood that the concepts of the present disclosure are not limited to control functions for the front-mounted work implement 142 and may further relate to other work vehicle components/attachments, or operating characteristics such as vehicle speed. For example, a work vehicle equipped with an object detection system may include safety features regarding a minimum distance to be maintained for forward or reverse movement, rotational movement, work implement extension, or the like, wherein the minimum distance or equivalent operating characteristic may be user-selectably adjustable during an automatic control mode without otherwise disrupting the ability of the controller to maintain automatic control generally.

In an embodiment, target values for control parameters of such characteristics may be entered numerically by the operator via user interface 142 and/or associated input devices such as from a touch screen or keyboard/mouse. However, for illustrative purposes the following description will focus on a target value for the elevation of the work implement 142.

During the manual control mode (step 320), and responsive to detected manual adjustments via a respectively configured joystick (step 322), which for the purposes of the description herein will be a first joystick 166 but may be a second joystick 168 or the only available joystick 166 depending on the configuration of the work vehicle 100, a magnitude of such adjustments is determined by the controller 138 (step 324) as corresponding to a velocity of the work implement, or ground engaging portion thereof, from a previous setting to a new setting for the first target value.

In an embodiment, a position sensor (not expressly shown in FIGS. 1-2) such as a potentiometer or other suitable sensor may be provided to detect the position of the joystick 166, for example along either or both of trajectories corresponding to an x-axis and a y-axis of movement from a neutral position centered about a z-axis (i.e., a longitudinal axis of the joystick 166) in an x-y-z coordinate system. The position sensor further may provide a signal representing the detected joystick position/actuation to the controller 138. Based on the detected position or actuation of the joystick 166, the controller 138 controls the velocity or rate for the work implement 142. As such, the displacement of the joystick 166 may be used to specify the instantaneous velocity of the blade tip.

As one example, forward or reverse movement of the joystick 166 along a trajectory in the direction of the y-axis and away from its neutral position results in controlling increasing the speed of the work implement 142 in a corresponding direction with respect to the elevation. The controller 138 may for example control the velocity of the work implement 142 to be substantially proportional to a degree of actuation of the joystick 166 away from its neutral position.

In some embodiments, movements of the joystick 166 to the left or the right along a trajectory in the direction of the x-axis and away from its neutral position may likewise result in control of a velocity in a corresponding clockwise or counter-clockwise direction with respect to tilt of the work implement 142. In other embodiments, one of skill in the art will appreciate that only movements of the joystick 166 (or an alternative user interface tool such as a lever) in the direction of the y-axis may be required and monitored for corresponding control functions.

In embodiments where for example the work implement 142 is a six-way blade, movements of the joystick 166 may still further be enabled in a rotational direction with respect to the z-axis of the joystick 166, wherein a direction of rotation of the joystick 166 about the z-axis corresponds to a direction of rotation of the work implement 142 (i.e., blade in the present embodiment) about its respective vertical axis.

It may be understood that in various embodiments a joystick 166 as otherwise described above is not limited to translation along only one axis, and may for example be moved diagonally to initiate/command corresponding movements of the work implement 142 in more than aspect, i.e., changes in elevation, changes in tilt, changes in rotation, and the like.

If no user-initiated adjustments are made to the position of the joystick 166 during the manual mode, prior to a subsequent selection of automatic mode (310), it may be understood that no adjustments are made to the previous setting for the first target value.

When the joystick 166 is returned to a neutral position during the manual mode (320), the first target value for the elevation of the work implement 142 is accordingly returned from the "new" setting to the "previous" setting (step 326), and controller 138 may simply await further detected manual adjustments to the position of the joystick 166 (322) and/or detected user selections of the automatic mode (310, 330).

In accordance with various embodiments of the present disclosure, during the automatic control mode (step 330), and responsive to detected manual adjustments via the joystick 166 (step 332), a magnitude of such adjustment is determined by the controller 138 (step 334) as corresponding to an amount of position adjustment from the previous setting to the new setting with respect to the first target value, as opposed to the conventional applications and as applied in the manual mode wherein the velocity of the work implement 142 is adjusted. When the joystick 166 is returned to a neutral position during the automatic mode (330), the first target value for the elevation of the work implement 142 is accordingly returned from the "new" setting to the "previous" setting (step 336)

Further during the automatic control mode (330) and in accordance with an embodiment as disclosed herein the controller 138, alone or in combination with other components of a work vehicle control system 200, continuously generates control signals to one or more actuators for regulating the elevation of the work implement 142 (step 338) based on the current target value and uninterrupted by any manual adjustments via the joystick 166 to the target value during steps 332 to 336, or in other words based on either of the previous or new settings depending on a current setting and without leaving or temporarily disabling automatic control. Otherwise stated, the controller 138 in the automatic control mode may be configured to continue rejecting disturbances like chassis motion, while and throughout manual adjustments by the operator to control a transition away from and back to the target value for the elevation using the joystick 166.

As used herein, the phrase "one or more of," when used with a list of items, means that different combinations of one or more of the items may be used and only one of each item in the list may be needed. For example, "one or more of"

item A, item B, and item C may include, for example, without limitation, item A or item A and item B. This example also may include item A, item B, and item C, or item B and item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A method of automatically controlling one or more operating characteristics for a self-propelled work vehicle comprising a work implement adjustable in position relative to a frame of the work vehicle and a user interface tool manually translatable from a neutral position along at least a first trajectory, the method comprising:

enabling a user-selectable transition of control of at least the work implement between a manual control mode and an automatic control mode;

wherein during the manual control mode a magnitude of manual adjustment by operator input via a user interface tool along the first trajectory corresponds to a velocity of adjustment of at least one of the operating characteristics with respect to the work implement;

establishing during the manual control mode a first setting of a target value for the at least one of the operating characteristics with respect to the work implement;

wherein upon transitioning from the manual control mode to the automatic control mode, the first setting of the target value corresponds to the neutral position for the user interface tool;

during the automatic control mode, continuously determining a magnitude of manual translation of the user interface tool in a first direction from the neutral position along the first trajectory, wherein each determined magnitude of manual translation corresponds to a respective amount of adjustment from the first setting to a respective new setting of the target value for the at least one of the operating characteristics; and the method further comprising, during the automatic control mode, continuously generating control signals to controllably adjust the at least one of the one or more operating characteristics to the first target value or the respective new value for a current position of the user interface tool, wherein the automatic control mode and the continuous generation of control signals are uninterrupted by the manual translation of the user interface tool.

2. The method of claim 1, wherein the work implement comprises a front-mounted work implement configured to work a terrain to at least a target mainfall and a target cross-slope, and wherein an actuator associated with the work implement is configured, responsive to the generated control signals, to controllably adjust an operating characteristic comprising elevation of the work implement to the first target value.

3. The method of claim 2, wherein the user interface tool is manually translatable from the neutral position along at least two different trajectories, wherein translation along a first trajectory for the user interface tool corresponds to changes in elevation for the work implement, and wherein translation along a second trajectory for the user interface tool corresponds to changes in tilt for the work implement.

4. The method of claim 3, wherein the transition of control from the automatic control mode to the manual control mode is executed at least responsive to manual translation of the user interface tool at least a threshold distance from the neutral position.

5. The method of claim 4, wherein the user interface tool comprises a joystick that is manually translatable from the neutral position along the at least two trajectories, and a button associated with the joystick wherein the transition of control between the manual control mode and the automatic control mode is further executed at least responsive to manual engagement of the button.

6. A self-propelled work vehicle comprising:

a frame supported by one or more ground engaging units;

a work implement adjustable in position relative to the frame;

an operator station comprising a user interface tool manually translatable from a neutral position along at least a first trajectory; and a controller configured to execute a user-selected transition of control of at least the work implement between a manual control mode and an automatic control mode;

wherein during the manual control mode a magnitude of manual adjustment by operator input via the user interface tool along the first trajectory corresponds to a velocity of adjustment of at least one of the operating characteristics with respect to the work implement;

establish during the manual control mode a first setting of a target value for the at least one of the operating characteristics with respect to the work implement;

wherein upon transitioning from the manual control mode to the automatic control mode, the first setting of the target value corresponds to the neutral position for the user interface tool;

during the automatic control mode, continuously determine a magnitude of manual translation of the user interface tool in a first direction from the neutral position along the first trajectory, wherein each determined magnitude of manual translation corresponds to a respective amount of adjustment from the first setting to a respective new setting of the target value for the at least one of the operating characteristics; and the controller is further configured, during the automatic control mode, to continuously generate control signals to controllably adjust the at least one of the one or more operating characteristics to the first target value or the respective new value for a current position of the user interface tool, wherein the automatic control mode and the continuous generation of control signals are uninterrupted by the manual translation of the user interface tool.

7. The work vehicle of claim 6, wherein the work implement comprises a front-mounted work implement configured to work a terrain to at least a target mainfall and a target cross-slope, and wherein an actuator associated with the work implement is configured, responsive to the generated control signals, to controllably adjust an operating characteristic comprising elevation of the work implement to the first target value.

8. The work vehicle of claim 7, wherein the user interface tool is manually translatable from the neutral position along at least two different trajectories, wherein translation along a first trajectory for the user interface tool corresponds to changes in elevation for the work implement, and wherein translation along a second trajectory for the user interface tool corresponds to changes in tilt for the work implement.

9. The work vehicle of claim 8, wherein the transition of control from the automatic control mode to the manual control mode is executed at least responsive to manual translation of the user interface tool at least a threshold distance from the neutral position.

10. The work vehicle of claim 9, wherein the user interface tool comprises a joystick that is manually translatable from the neutral position along the at least two trajectories, and a button associated with the joystick wherein the transition of control between the manual control mode and the automatic control mode is further executed at least responsive to manual engagement of the button.

11. The work vehicle of claim 6, further comprising a display unit associated with the operator station, wherein the controller is configured to generate at least one display value on the display unit representative of an intended adjustment to the first target value, dependent on the selected control mode.

12. A control system for automatically controlling one or more operating characteristics for a self-propelled work vehicle, the work vehicle comprising a frame supported by one or more ground engaging units, a work implement adjustable in position relative to the frame, and an operator station comprising a user interface tool manually translatable from a neutral position along at least a first trajectory, the system comprising:

one or more processors functionally linked to the user interface tool and configured to:

determine a user-selected transition of control of at least the work implement between a manual control mode and an automatic control mode;

wherein during the manual control mode a magnitude of manual adjustment by operator input via the user interface tool along the first trajectory corresponds to a velocity of adjustment of at least one of the operating characteristics with respect to the work implement;

establish during the manual control mode a first setting of a target value for the at least one of the operating characteristics with respect to the work implement;

wherein upon transitioning from the manual control mode to the automatic control mode, the first setting of the target value corresponds to the neutral position for the user interface tool;

during the automatic control mode, continuously determine a magnitude of manual translation of the user interface tool in a first direction from the neutral position along the first trajectory, wherein each determined magnitude of manual translation corresponds to a respective amount of adjustment from the first setting to a respective new setting of the target value for the at least one of the operating characteristics; and during the automatic control mode, to continuously direct the generation of control signals to controllably adjust the at least one of the one or more operating characteristics to the first target value or the respective new value for a current position of the user interface tool, wherein the automatic control mode and the continuous generation of control signals are uninterrupted by the manual translation of the user interface tool.

13. The system of claim 12, wherein the work implement comprises a front-mounted work implement configured to work a terrain to at least a target mainfall and a target cross-slope, and wherein an actuator associated with the work implement is configured, responsive to the generated control signals, to controllably adjust an operating characteristic comprising elevation of the work implement to the first target value.

14. The system of claim 13, wherein the user interface tool is manually translatable from the neutral position along at least two different trajectories, wherein translation along a first trajectory for the user interface tool corresponds to changes in elevation for the work implement, and wherein translation along a second trajectory for the user interface tool corresponds to changes in tilt for the work implement.

15. The system of claim 14, wherein the transition of control from the automatic control mode to the manual control mode is executed at least responsive to manual translation of the user interface tool at least a threshold distance from the neutral position.

16. The system of claim 15, wherein the user interface tool comprises a joystick that is manually translatable from the neutral position along the at least two trajectories, and a button associated with the joystick wherein the transition of control between the manual control mode and the automatic control mode is further executed at least responsive to manual engagement of the button.

17. The system of claim 12, the work vehicle further comprising a display unit associated with the operator station, wherein the one or more processors are configured to direct the generation of at least one display value on the display unit representative of an intended adjustment to the first target value, dependent on the selected control mode.

* * * * *